United States Patent [19]

Armstead, Jr.

[11] Patent Number: 4,572,092

[45] Date of Patent: Feb. 25, 1986

[54] HANDWHEEL MODIFIED FOR IMPROVED LUBRICATION AND COOLING

[75] Inventor: George B. Armstead, Jr., Glastonbury, Conn.

[73] Assignee: The Merrow Machine Company, Newington, Conn.

[21] Appl. No.: 534,516

[22] Filed: Sep. 21, 1983

[51] Int. Cl.[4] ..... D05B 71/00

[52] U.S. Cl. ..... 112/256; 384/134; 416/60

[58] Field of Search ..... 384/412, 134, 478; 308/187; 112/256, 43, 280; 416/60

[56] References Cited

U.S. PATENT DOCUMENTS

| | | | |
|---|---|---|---|
| 1,999,978 | 4/1935 | Myers | 112/256 |
| 2,879,733 | 3/1959 | Pierce | 112/256 |
| 3,478,709 | 11/1969 | Fischbein et al. | 112/256 |
| 3,644,004 | 2/1972 | Hand | 384/134 |
| 3,650,582 | 3/1972 | Casey | 384/134 |
| 4,004,528 | 1/1977 | Adams et al. | 112/280 |
| 4,062,310 | 12/1977 | Gauch et al. | 112/280 |
| 4,145,985 | 3/1979 | Klundt | 112/280 |
| 4,340,014 | 7/1982 | Kinchweger | 416/60 |

FOREIGN PATENT DOCUMENTS

| | | | |
|---|---|---|---|
| 691663 | 5/1953 | United Kingdom | 112/256 |

*Primary Examiner*—Werner H. Schroeder
*Assistant Examiner*—Andrew M. Falik
*Attorney, Agent, or Firm*—Beveridge, DeGrandi and Weilacher

[57] ABSTRACT

A sewing machine has a housing and a mechanism in the housing for actuating the sewing elements of the machine. The mechanism includes a rotating shaft with a drive end which protrudes from the housing and carries a handwheel. The handwheel has a surface which is proximate to the housing to provide a thin space between the surface and the housing. Wheel rotation during machine operation causes centrifugal movement of air in the space toward the circumference of the space. The wheel has openings which supply air to the space to cool the wheel and prevent the aspiration of fluids from the housing by the centrifugal movement of air in the space.

9 Claims, 2 Drawing Figures

HANDWHEEL MODIFIED FOR IMPROVED LUBRICATION AND COOLING

BACKGROUND OF THE INVENTION

This invention relates to an improved sewing machine in which the use of a modified handwheel results in improved lubrication, lower machine temperatures, reduced maintenance, and an increased lifetime of the machine's components.

The present invention, although applicable to many types of sewing machines, has proven to be quite effective in connection with an overedge sewing machine of the well-known "Merrow" type illustrated in prior U.S. Pat. Nos. 2,879,733 and 3,958,460. The disclosures of these two U.S. patents are incorporated herein by reference.

In the Merrow machine, a primary drive shaft extends through a housing and has its driven end protruding outwardly of the housing. The protruding end of the shaft carries the handwheel which has a circumferential groove driven by a V-belt. The shaft is journaled in the housing and typically is supported on a needle bearing located near the handwheel. The handwheel is spaced closely to the housing exterior. This spacing prevents thread and debris from entering between the handwheel and the housing, and it also minimizes the lever arm between the pulley groove and the shaft bearing. During normal machine operations, the V-belt drives the handwheel at a high speed, typically about 5500 rpm.

The incidence of failure of the needle bearings in such machines has been greater than desirable. In a previous effort to avert such failures, a lubricant supply passage was connected directly to the needle bearing, but this resulted in excessive oil loss at the exterior of the housing. Now, it has been discovered that a source of the problem was that the high speed rotation of the handwheel in close proximity to the housing caused fluids to be centrifugally propelled radially outward in the space between the handwheel and housing. This centrifugal effect caused air and lubricant to be aspirated along the shaft, inhibiting proper bearing operation and increasing friction. The present invention overcomes this problem and causes the machine to run at cooler temperatures, thereby increasing the comfort of the machine operator and the lifetime of the machine components.

SUMMARY OF THE INVENTION

The advantages set forth above are provided by this invention which includes a sewing machine having a housing, and a mechanism in the housing for actuating the sewing elements of the machine. This mechanism includes a shaft which is rotatable in the housing. A wheel, mounted on the shaft for rotation therewith, is located outside the housing and has a surface which is proximate to the housing to provide a thin space between the surface of the housing. The wheel is rotatable during operation of the machine, thereby causing centrifugal movement of air in the space toward the circumference of the space. The wheel has at least one opening leading to the space to supply air to the space to prevent the aspiration of fluids from the housing by the centrifugal movement of air in the space. The opening also reduces the temperature of the wheel during machine operation by increasing the volumetric flow of air moving centrifugally in the space.

Preferably, a bearing in the housing rotatably supports the shaft and is located near the wheel, and a means is provided for supplying lubricant to the bearing. The opening in the wheel prevents the aspiration of the lubricant from the housing. Typically, the wheel includes an oil slinger located radially inwardly of the space, the housing has an external recess which receives the oil slinger, and a lubricant return passage is connected to the external recess. The wheel is preferably aluminum.

More specifically, the invention relates to a drive mechanism for a sewing machine wherein a shaft mounted for rotation in a housing has an end protruding axially from the housing. A wheel is mounted on the protruding end of the shaft. Lubricant from a reservoir is supplied to an interface between the shaft and the housing, and a recess surrounding the shaft is on the exterior of the housing in communication with the reservoir for returning lubricant to the reservoir. The wheel is provided with a lubricant slinger which extends radially outward of the shaft in close proximity to the recess for assisting the return of lubricant to the reservoir. A web on the wheel extends radially outward of the slinger, slightly spaced from the housing. The web has an axial hole radially outward of the slinger, exposing the housing as the wheel is rotated by the shaft. The axial hole supplies ambient air to the space between the web and the housing so that the ambient air is centrifugally propelled in said space in response to rotation of the wheel.

Preferably, the web includes a pulley having an annular groove adapted to receive a drive belt, and the annular groove intersects the axial hole. The web is spaced not more than about 0.125 inch from the housing, and the exterior of the housing has an annular rim surrounding the web in close fitting relation. A bearing, such as a needle bearing, is provided in at least a part of the interface between the shaft and the housing, and the lubrication means provides lubricant to the bearing. The lubrication means includes an axial lubricant supply bore in the shaft, and an outlet which leads from the bore to the bearing to communicate lubricant to the bearing.

The features of the invention will hereinafter become apparent from the arrangements and combinations of parts as fully set forth in the following detailed description and drawing of a preferred embodiment.

DESCRIPTION OF THE PREFERRED EMBODIMENT

Figure 2:
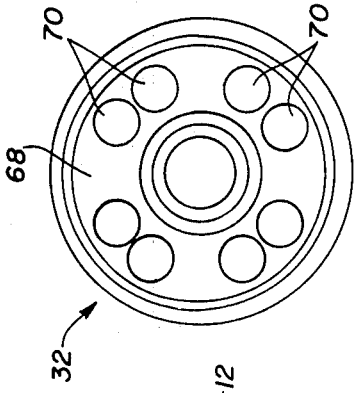
FIG. 2 is a view of the outer face of the handwheel of the machine.
Figure 1:
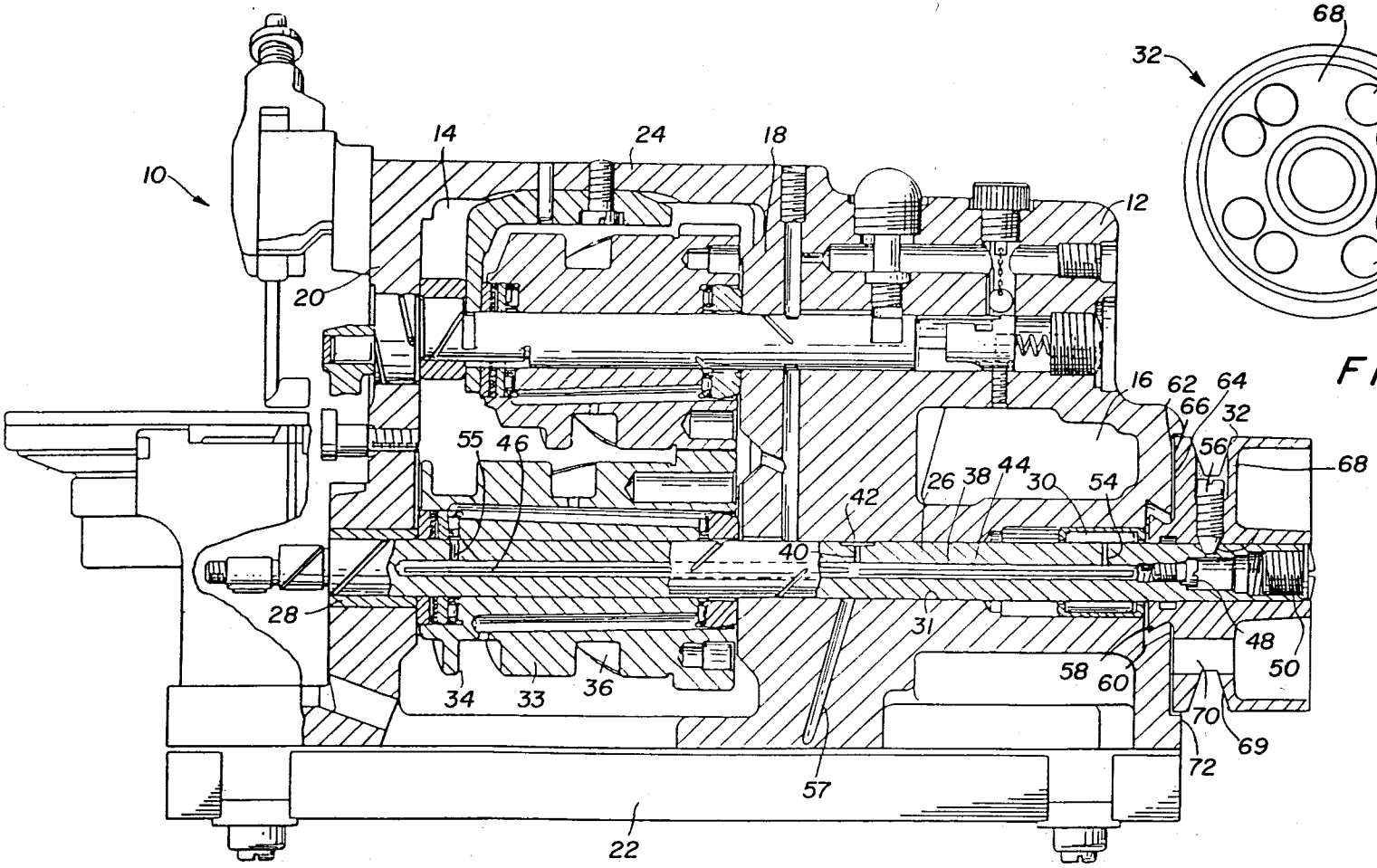
FIG. 1 is an elevation view, in section, of an overedge sewing machine embodying the invention.

Referring now to the drawing in detail, a cam driven overedge sewing machine embodying the present invention is indicated generally by the reference number 10. It includes a main housing 12 having a mechanism compartment 14 and an oil reservoir compartment 16, with the mechanism compartment and oil reservoir being separated by a partition 18. An end wall 20, a base plate 22 and top wall portion 24 complete the enclosure for the mechanism compartment 14.

A main or lower drive shaft 26 extends through the housing 12 and is journaled for rotation by suitable bearings such as bushing 28, needle bearing 30, and the inner bearing surface a of bore 31. A handwheel 32 is mounted on the protruding right end of the shaft 26, and a lower cam cylinder 33 is rigidly affixed by set screws to the shaft 26 within the mechanism compartment 14.

Endless cam grooves 34 and 36 formed in the cam cylinder 33 are engaged by cam followers, not shown, on the machine's lower looper carriers in the manner illustrated in U.S. Pat. No. 2,879,733. That patent illustrates the operation of the loopers and related mechanisms as well as the primary lubrication and sealing systems of the machine and should be referred to for such details.

The shaft 26 has an axially extending bore 38 which receives oil from radially extending opening 40 in an eccentric groove 42. Metering and conducting rods 44 and 46 are positioned within the bore 38 to assure the axial distribution of oil. A screw 48 closes the right end of the bore 38. Screw 50 is provided at the extreme right hand end of bore 38 as a safety precaution and to permit convenient use of certain types of tachometers in measuring the speed of the sewing machine. The bore 38 has two oil outlet openings 54 and 55.

The interface between the housing 12 and shaft 26 is continuously supplied with an excess of lubricating oil to assure adequate lubrication of the high speed bearings. Oil is supplied by a pump and passage, not shown, to the bushing 28 at the left end of the shaft 26. Passage 57 carries oil to the eccentric 42 on shaft 26 where some oil lubricates the inner bearing surface of bore 31 and some oil enters the passage 38 via the opening 40. Oil from passage 38 lubricates the left thrust bearings in cam 33 via outlet opening 55 and the needle bearings 30 at the right end of the shaft 26 via outlet opening 54.

The handwheel 32 is secured on the protruding drive end of the shaft 26 by a set screw 56. The handwheel includes an oil slinger 58 which centrifugally propels any lubricant escaping past needle bearing 30 outward into an annular recess 60, which serves as the slinger chamber. The recess 60 is connected by a drain passage to a lower chamber of the machine's oil reservoir.

The housing has a circular external recess providing a surface 62 which is separated from an internal surface 64 of the handwheel by a thin space 66. The handwheel 32 includes a web portion 68 which is provided with a pulley groove 69 and extends radially outward of the slinger 58. As shown in FIG. 2 several apertures or holes 70 are formed through the web 68 of the handwheel, exposing the external face 62 of housing 12.

The surface 62 of the housing is surrounded by an annular rim 72 which prevents thread and other debris from entering the space 66 between the handwheel and the housing to cause fouling. The internal face 64 of the wheel 32 is axially spaced about 0.04 to about 0.06 from the external face 62 of the housing. The narrow spacing helps prevent the entry of foreign matter into the space 66, and it minimizes the lever arm distance between the pulley groove 69 and the needle bearing 30.

This invention has resulted from the discovery that, in earlier machines, the narrow spacing between faces 62 and 64 resulted in centrifugal movement of air in the space 66 when the handwheel rotated at typical speeds of around 5500 rpm. This reduced the pressure near the center of the space 66, causing fluids to be aspirated from the slinger recess 60 and from the interface between shaft 26 and housing 12. This, in turn, led to overheating of the apparatus and premature failure of the needle bearing 30. Efforts were made to solve the problem of bearing failure by providing the lubrication outlet 54 in the shaft 26, leading to the needle bearing 30. It was expected that the slinger 58 and recess 60 would carry away excess lubricant. However, unacceptable quantities of oil were discharged to the outside of the machine in the vicinity of the rotating handwheel.

The provision of the holes 70 in the handwheel 32 solved the problems of excessive oil discharge, premature bearing failure, and machine overheating. The holes 70 provide abundant air to the space 66 between the handwheel and the housing; therefore, the centrifugal propulsion of air by rotation of the handwheel no longer aspirates either oil or air from the recess 60 or from along the shaft 26. Since oil is no longer aspirated from the recess 60, outlet 54 can be used to provide oil to the bearing 30 without causing oil leakage from the machine. Moreover the volume of air moving through holes 70 and radially outward in the space 66 is increased substantially, providing a cooling effect. This cooling effect is further enhanced if the handwheel is made of aluminum, which is a good heat conductor and is the preferred material for the handwheel. In addition, aluminum is a lightweight material so that the machine will have reduced inertia, facilitating its precision starting and stopping.

The high thermal conductivity of the handwheel also assists in the dissipation of heat from the interior of the machine. When the machine is stopped by the operator, the internal heat is conducted to the handwheel. Then, when the operator starts the machine, this heat is quickly given off to the air which flows through and around the handwheel.

The cooling of the handwheel results in a cooler machine altogether and increases the lifetime of the bearings 30. The cooling effect is dramatic: conventional cast iron wheels rise in temperature to 130°–140° F. after about four hours use; handwheels according to the present invention run continuously at or near room temperature. The number of needle bearing failures in machines incorporating the present invention has fallen far below that which would have been expected in previous machines.

Persons familiar with the field of the invention will appreciate that the principles of the invention are applicable to many machines, and are susceptable to numerous modifications. Accordingly, it is emphasized that the invention is not limited to the disclosed embodiment but embraces all machines which fall within the spirit of the following claims.

I claim:

1. In a sewing machine which has a housing, a mechanism which has sewing elements and drive means for the sewing elements, said drive means including a shaft which is rotatable in said housing, a bearing in said housing for rotatably supporting said shaft, means for supplying lubricant to said bearing, a wheel mounted on said shaft for rotation therewith, said wheel being located outside said housing, said wheel and said housing having substantially continuous surfaces which are in close proximity to each other to provide a thin space between said wheel and said housing, said space being sufficiently thin and the rotation of the shaft being such that, in the absence of the improvement recited below, the rotation of said wheel is operable to reduce the pressure near the center of the space so that lubricant is aspirated from within the housing, the improvement wherein the wheel is provided with means for preventing the aspiration of lubricant from the housing, said means for preventing such aspiration being an opening means formed in the wheel for supplying atmospheric air to said space.

2. A sewing machine as claimed in claim 1 wherein said opening means comprises an axial hole and said wheel has a circumferential groove intersecting said opening means.

3. A sewing machine as claimed in claim 1 wherein said thin space has a thickness which is not more than about 0.125 inch.

4. A sewing machine as claimed in claim 1 wherein said housing has an annular rim closely surrounding but not touching said wheel.

5. A sewing machine as claimed in claim 1 wherein said wheel is aluminum.

6. A sewing machine according to claim 1 wherein the wheel includes an oil slinger located radially inward of said space, said housing has an external recess which receives said oil slinger, and a lubricant return passage connected to said external recess.

7. A sewing machine as claimed in claim 1 wherein said means for supplying lubricant to said bearing includes an axial lubricant supply bore in said shaft, and a radial outlet from said bore to said bearing.

8. In a machine which has a housing, a shaft which is rotatable in said housing, a bearing in said housing for rotatably supporting said shaft, means for supplying lubricant to said bearing, a wheel mounted on said shaft for rotation therewith, said wheel being located outside said housing, said wheel and said housing having substantially continuous surfaces which are in close proximity to each other to provide a thin space between said wheel and said housing, said space being thin and the rotation of the shaft being such that, in the absence of the improvement recited below, the rotation of said wheel is operable to reduce the pressure near the center of the space so that lubricant is aspirated from within the housing, the improvement wherein the wheel is provided with means for preventing the aspiration of lubricant from the housing, said means for preventing such aspiration being an opening means formed in the wheel for supplying atmospheric air to said space.

9. A machine according to claim 8 which is a sewing machine, said sewing machine having sewing elements and drive means for the sewing elements, said drive means including said shaft, said wheel being a handwheel for the sewing machine.

* * * * *